US011800892B2

(12) United States Patent
Daily et al.

(10) Patent No.: US 11,800,892 B2
(45) Date of Patent: Oct. 31, 2023

(54) SYSTEM, METHOD AND ASSEMBLY FOR SMOKING DEVICE

(71) Applicant: GRAVITRON, LLC, Austin, TX (US)

(72) Inventors: David Daily, Austin, TX (US); Micah Evans, Austin, TX (US); Travis Dodson, Austin, TX (US)

(73) Assignee: GRAVITRON, LLC, Austin, TX (US)

( * ) Notice: Subject to any disclaimer, the term of this patent is extended or adjusted under 35 U.S.C. 154(b) by 302 days.

(21) Appl. No.: 17/368,088

(22) Filed: Jul. 6, 2021

(65) Prior Publication Data

US 2023/0007868 A1 Jan. 12, 2023

(51) Int. Cl.

| | |
|---|---|
| ***A24F 1/06*** | (2006.01) |
| ***A24F 1/32*** | (2006.01) |
| ***A24F 5/00*** | (2006.01) |
| ***A24F 1/30*** | (2006.01) |

(52) U.S. Cl.

CPC ..... *A24F 1/06* (2013.01); *A24F 1/30* (2013.01); *A24F 1/32* (2013.01); *A24F 5/00* (2013.01)

(58) Field of Classification Search

CPC ..... A24F 1/30; A24F 1/32

See application file for complete search history.

(56) References Cited

U.S. PATENT DOCUMENTS

2002/0074006 A1* 6/2002 Gunn ..... A24F 1/30 131/173

2015/0289563 A1* 10/2015 Hood ..... A24F 1/32 131/222

* cited by examiner

*Primary Examiner* — Philip Y Louie
*Assistant Examiner* — Miles A Simpson
(74) *Attorney, Agent, or Firm* — Dickinson Wright PLLC

(57) ABSTRACT

A system for smoking a product includes a vase for containing a liquid. The vase has a closed bottom, and a side wall extending from the closed bottom and an open top that is unobstructed. The system further includes a bottle for inserting into and removing from the vase. The bottle has an open bottom, an open top, a flange circumscribing the bottle adjacent the open top, and a conical opening in the open top that is unobstructed. In addition, the system includes a grommet mounted to the open bottom of the bottle such that the open bottom is substantially unobstructed. Lastly, the system includes a bowl with a conical exterior that is complementary in shape to the conical opening in the bottle. The bowl can form a conical, glass-to-glass seal with the bottle.

20 Claims, 4 Drawing Sheets

SYSTEM, METHOD AND ASSEMBLY FOR SMOKING DEVICE

CROSS-REFERENCE TO RELATED APPLICATION

None.

TECHNICAL FIELD

This disclosure relates in general to smoking devices and, in particular, to a system, method and assembly for a smoking device.

BACKGROUND

Many different types of conventional smoking devices are known in the prior art. Nonetheless, improvements in smoking devices continue to be of interest.

SUMMARY

Embodiments of a system, method and assembly for a smoking device are disclosed. For example, a system for smoking a product includes a vase for containing a liquid, such as water. The vase has a closed bottom, and a side wall extending from the closed bottom and an open top that is unobstructed. The system further includes a bottle for inserting into and removing from the vase. The bottle has an open bottom, an open top, a flange circumscribing the bottle adjacent the open top, and a conical opening in the open top that is unobstructed. In addition, the system includes a grommet mounted to the open bottom of the bottle such that the open bottom is substantially unobstructed. Lastly, the system includes a bowl with a conical exterior that is complementary in shape to the conical opening in the bottle. The bowl can form a conical, glass-to-glass seal with the bottle.

BRIEF DESCRIPTION OF THE DRAWINGS

So that the manner in which the features and advantages of the embodiments are attained and can be understood in more detail, a more particular description can be had by reference to the embodiments that are illustrated in the appended drawings. However, the drawings illustrate only some embodiments and are not to be considered limiting in scope since there can be other equally effective embodiments.

It shall be noted that some of the details and/or features shown in the drawings herein may not be drawn to scale for clarity purposes.

FIG. 2 is an exploded sectional side view of an embodiment of bottle and grommet portions of the smoking device of.

The use of the same reference symbols in different drawings indicates similar or identical items.

DETAILED DESCRIPTION

Figure 1:
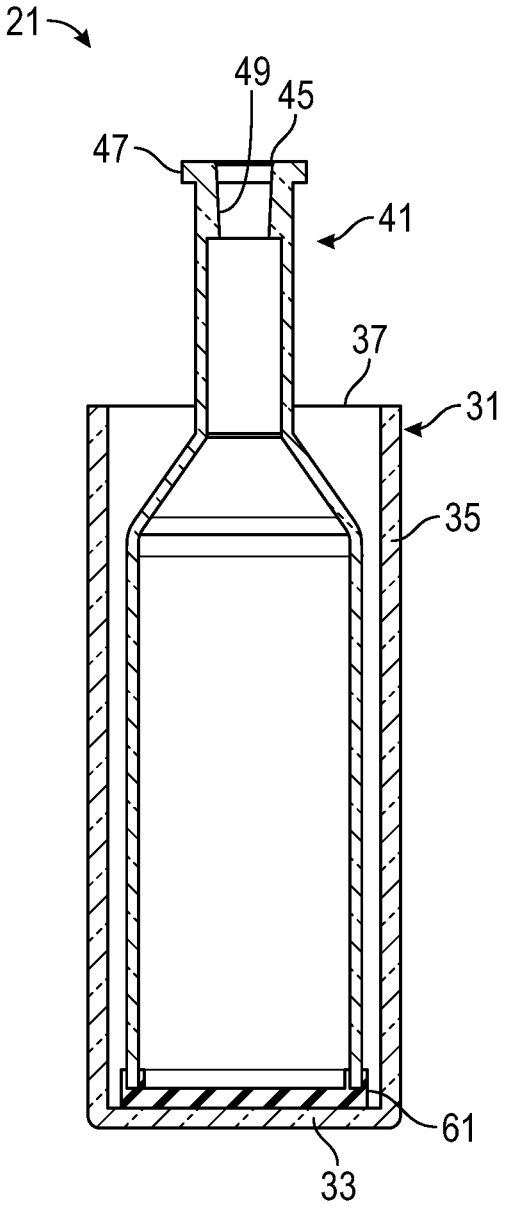
FIG. 1 is a sectional side view of an embodiment of an assembly for a smoking device.
Figure 2:
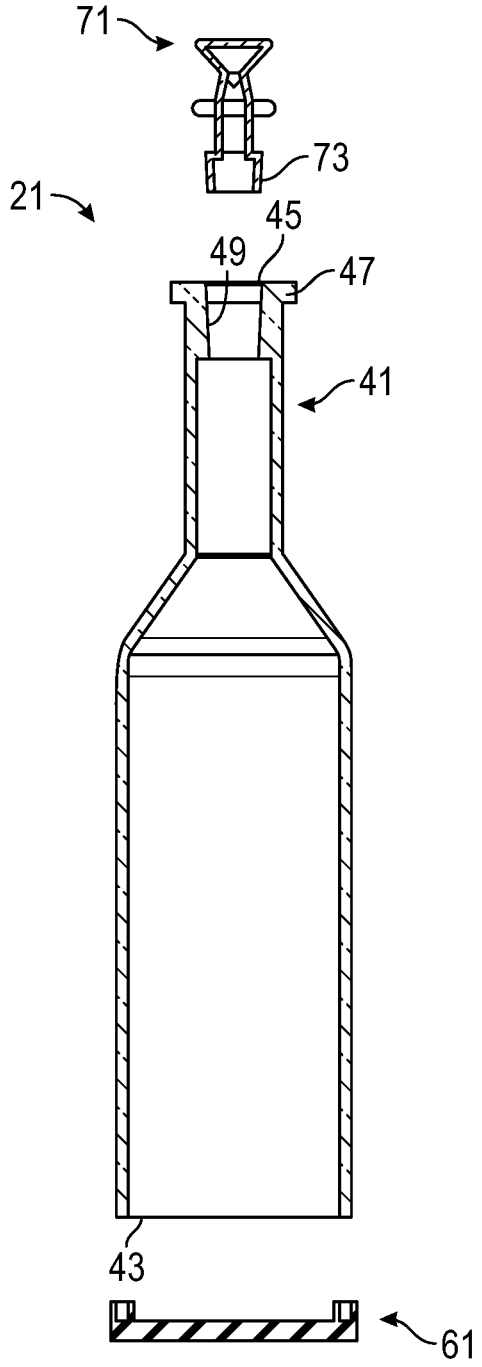
Figure 3:
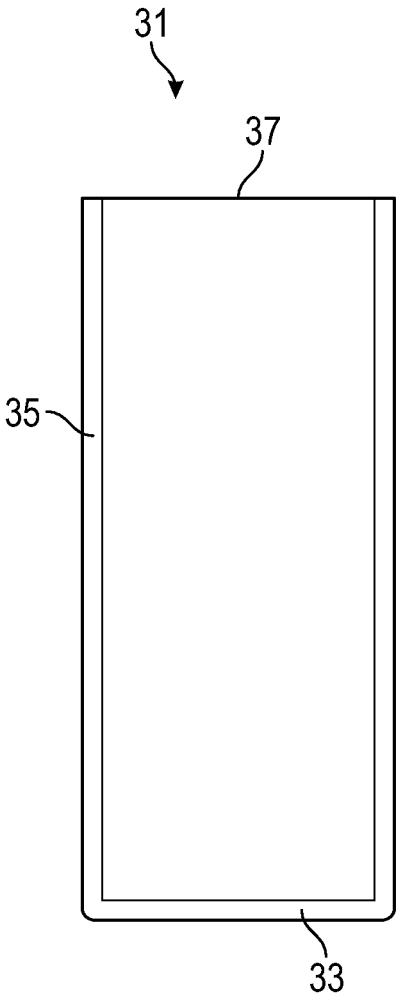
FIG. 3 is a side view of an embodiment of a vase portion of the smoking device.
Figure 4:
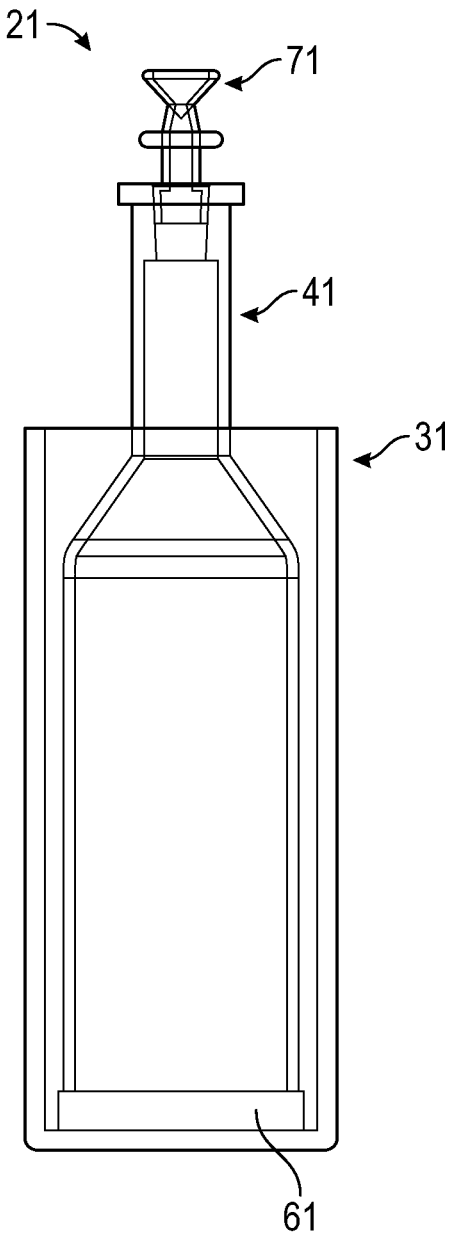
FIG. 4 is a side view of an embodiment of an assembly of the smoking device.
Figure 5:
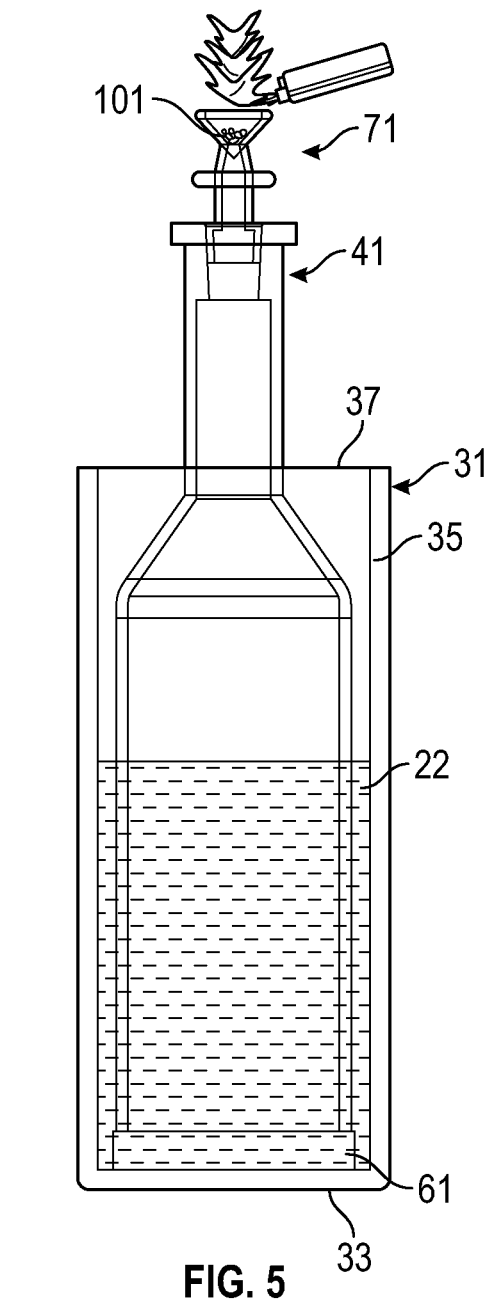
FIG. 5 is a side view of an embodiment of the assembly at an initial stage of operation.
Figure 6:
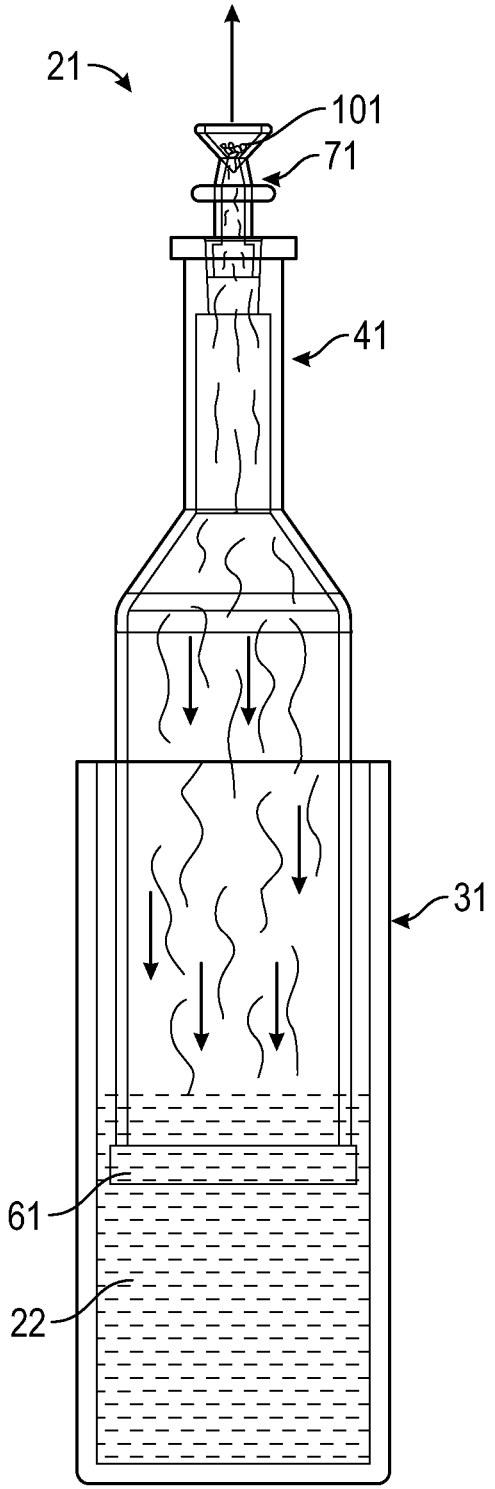
FIG. 6 is a side view of an embodiment of the assembly at an intermediate stage of operation.
Figure 7:
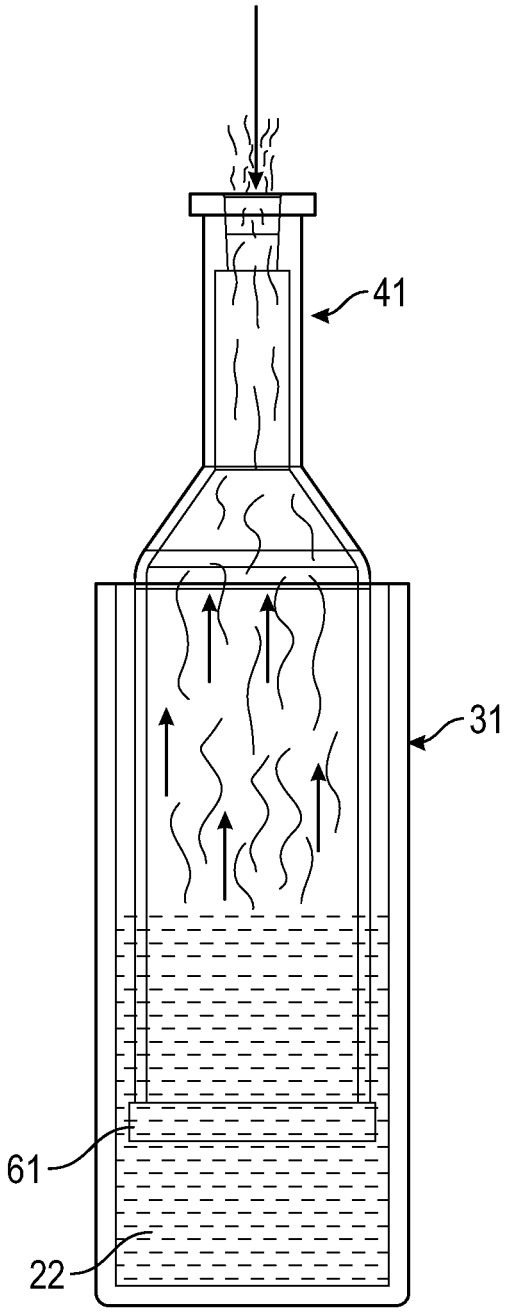
FIG. 7 is a side view of an embodiment of the assembly at an advanced stage of operation.

FIGS. 1-7 depict embodiments of systems, method and assembly for a smoking device. For example, a system 21 for smoking a product 101 (FIGS. 5-6) can include a vase 31 configured to contain a liquid 22. Versions of the vase 31 can have a closed bottom 33, and a side wall 35 extending from the closed bottom and an open top 37 that is unobstructed.

Embodiments of a bottle 41 can be configured to be inserted into and removed from the vase 31. The bottle 41 can have an open bottom 43, an open top 45, a flange 47 circumscribing the bottle adjacent the open top, and an opening 49 in the open top 45 that is unobstructed. In one example, the flange 47 on the bottle 41 can be rectangular in sectional shape. In another example, the opening 49 can be a conical opening 49. A grommet 61 can be mounted to the open bottom 43 of the bottle 41 such that the open bottom 43 is substantially or completely unobstructed.

In addition, a bowl 71 that is removable can be complementary in shape to the opening 49 in the bottle 41. Like the opening 49, the bowl 71 can have a conical exterior 73 that is configured to form a complementary, conical, glass-to-glass seal therebetween. Versions of both the conical opening 49 in the bottle 41 and the conical exterior 73 of the bowl 71 can include a ground glass texture that is not smooth glass.

Examples of the system 21 can comprise no o-rings for sealing between the conical opening 49 in the bottle 41 and any other components of the system 21. Another embodiment of the system 21 can consist of only the vase 31, bottle 41, grommet 61 and bowl 71, such that the system 21 comprises no other component. In one example, the system 21 does not comprise a down stem (a prior art component) located between the bottle 41 and the bowl 71.

Embodiments of the grommet 61 can comprise or consist of silicone. The silicone can be platinum-cured, in some versions. Other examples of the grommet 61 can have a U-shaped sectional profile with an open grommet top into which the open bottom 43 of the bottle 41 can be inserted. Compare FIGS. 1 and 2. The grommet 61 also can have a closed bottom against which the open bottom 43 of the bottle 41 can seat, such that the grommet 61 contacts both an inner surface and an outer surface of the bottle 41 adjacent the open bottom 43. In addition, a bottom outer rim of the grommet 61 can be generally rectangular in sectional shape.

Another embodiment of a system 21 for smoking a product 101 can include the vase 31 to contain a liquid 22, a closed bottom 33, a side wall 35 extending from the closed bottom and an open top 37 that is unobstructed. The bottle 41 can be inserted into and removed from the vase 31. The bottle 41 can have an open bottom 43, an open top 45, a flange 47 circumscribing the bottle adjacent the open top, and an opening 49 in the open top that is unobstructed. The grommet 61 can be mounted to the open bottom 43 of the bottle such that the open bottom is substantially unobstructed. The bowl 71 can have an exterior 73 that is complementary in shape to the opening 49 in the bottom. Both the opening 49 and the exterior 73 can include a ground glass texture and configured to form a glass-to-glass seal therebetween. The system 21 can have no o-rings for sealing the opening or any other components. The system 21 can include or consist of the other components and features described herein.

One version of the system includes the vase 31, bottle 41, grommet 61 and bowl 71. The bowl 71 can have an exterior 73 that is complementary in shape to the opening 49 in the bottle 41. Both the opening 49 and the exterior 73 can form a glass-to-glass seal therebetween. This version of the system 21 does not comprise o-rings or a down stem located between the bottle 41 and the bowl 71, such that the system 21 comprises no other component and consists of the vase 31, bottle 41, grommet 61 and bowl 71.

Both the vase 31 and the bottle 41 can have cylindrical interiors and exteriors.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Moreover, various functions described herein can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), solid state drive (SSD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

What is claimed is:

1. A system for smoking a product, the system comprising:

a vase configured to contain a liquid, the vase comprising a closed bottom, a side wall extending from the closed bottom and an open top that is unobstructed;

a bottle configured to be inserted into and removed from the vase, the bottle having an open bottom, an open top, a flange circumscribing the bottle adjacent the open top, and a conical opening in the open top that is unobstructed;

a grommet mounted to the open bottom of the bottle such that the open bottom is substantially unobstructed; and a bowl with a conical exterior that is complementary in shape to the conical opening in the bottle and configured to form a conical, glass-to-glass seal therebetween.

2. The system of claim 1, wherein the system comprises no o-rings for sealing between the conical opening in the bottle and any other components.

3. The system of claim 1, wherein the system comprises no other component, such that the system consists of the vase, bottle, grommet and bowl.

4. The system of claim 1, wherein the system does not comprise a down stem configured to be located between the bottle and the bowl.

5. The system of claim 1, wherein both the conical opening in the bottle and the conical exterior of the bowl comprise a ground glass texture that is not smooth glass.

6. The system of claim 1, wherein the flange on the bottle is rectangular in sectional shape.

7. The system of claim 1, wherein the grommet comprises silicone and is platinum-cured.

8. A system for smoking a product, the system comprising:

a vase configured to contain a liquid, the vase comprising a closed bottom, a side wall extending from the closed bottom and an open top that is unobstructed;

a bottle configured to be inserted into and removed from the vase, the bottle having an open bottom, an open top, a flange circumscribing the bottle adjacent the open top, and an opening in the open top that is unobstructed;

a grommet mounted to the open bottom of the bottle such that the open bottom is substantially unobstructed;

a bowl with an exterior that is complementary in shape to the opening in the bottom, both the opening and the exterior comprise a ground glass texture and configured to form a glass-to-glass seal therebetween; and the system comprises no o-rings for sealing the opening or any other components.

9. The system of claim 8, wherein the grommet comprises a U-shaped sectional profile with an open grommet top into which the open bottom of the bottle is inserted, and a closed bottom against which the open bottom of the bottle can seat, such that the grommet contacts both an inner surface and an outer surface of the bottle adjacent the open bottom, and a bottom outer rim of the grommet is generally rectangular in sectional shape.

10. The system of claim 8, wherein the system comprises no other component, such that the system consists of the vase, bottle, grommet and bowl.

11. The system of claim 8, wherein the system does not comprise a down stem configured to be located between the bottle and the bowl.

12. The system of claim 8, wherein the flange on the bottle is rectangular in sectional shape.

13. The system of claim 8, wherein the grommet comprises silicone and is platinum-cured.

14. The system of claim 8, wherein the grommet comprises a U-shaped sectional profile with an open grommet top into which the open bottom of the bottle is inserted, and a closed bottom against which the open bottom of the bottle can seat, such that the grommet contacts both an inner surface and an outer surface of the bottle adjacent the open bottom, and a bottom outer rim of the grommet is generally rectangular in sectional shape.

15. The system of claim 8, wherein both the opening and the exterior are conical to form a conical, glass-to-glass seal therebetween.

16. A system for smoking a product, the system comprising:

a vase configured to contain a liquid, the vase comprising a closed bottom, a side wall extending from the closed bottom and an open top that is unobstructed;

a bottle configured to be inserted into and removed from the vase, the bottle having an open bottom, an open top, a flange circumscribing the bottle adjacent the open top, and an opening in the open top that is unobstructed;

a grommet mounted to the open bottom of the bottle such that the open bottom is substantially unobstructed;

a bowl with an exterior that is complementary in shape to the opening in the bottle, both the opening and the exterior are configured to form a glass-to-glass seal therebetween; and wherein the system does not comprise o-rings or a down stem located between the bottle and the bowl, such that the system comprises no other component and consists of the vase, bottle, grommet and bowl.

17. The system of claim 16, wherein the flange on the bottle is rectangular in sectional shape.

18. The system of claim 16, wherein the grommet comprises silicone and is platinum-cured.

19. The system of claim 16, wherein the grommet comprises a U-shaped sectional profile with an open grommet top into which the open bottom of the bottle is inserted, and a closed bottom against which the open bottom of the bottle can seat, such that the grommet contacts both an inner surface and an outer surface of the bottle adjacent the open bottom, and a bottom outer rim of the grommet is generally rectangular in sectional shape.

20. The system of claim 16, wherein both the opening and the exterior comprise a ground glass texture and are conical in shape to form a conical, glass-to-glass seal therebetween; and both the vase and the bottle comprise cylindrical interiors and exteriors.

* * * * *